US007429043B1

(12) United States Patent
Ventura

(10) Patent No.: US 7,429,043 B1
(45) Date of Patent: Sep. 30, 2008

(54) TOY BOWLING GAME FOR PROVIDING PLAYER ENJOYMENT

(76) Inventor: Roy Ventura, 45-265 William Henery Rd., Kaneohe, HI (US) 96744

( * ) Notice: Subject to any disclaimer, the term of this patent is extended or adjusted under 35 U.S.C. 154(b) by 338 days.

(21) Appl. No.: 11/404,247

(22) Filed: Apr. 14, 2006

(51) Int. Cl.
*A63F 7/00* (2006.01)

(52) U.S. Cl. ..... 273/118 R

(58) Field of Classification Search ..... 273/118 R, 273/118 A, 119 R, 119 A, 120 R, 120 A, 273/121 R, 121 A, 108, 440; 446/168
See application file for complete search history.

(56) References Cited

U.S. PATENT DOCUMENTS

| | | | | | |
|---|---|---|---|---|---|
| 823,049 | A | * | 6/1906 | Kelly | 273/352 |
| 1,531,880 | A | | 3/1925 | Ritter | |
| 1,615,218 | A | * | 1/1927 | Dupuis | 273/127 D |
| 1,620,912 | A | * | 3/1927 | Okel | 273/119 R |
| 1,653,545 | A | | 12/1927 | Buedingen | |
| 2,010,213 | A | | 8/1935 | Bergoffen | |
| 2,101,188 | A | * | 12/1937 | Orcutt et al. | 273/119 A |
| 2,192,873 | A | | 3/1940 | Turrall | |
| 2,446,702 | A | * | 8/1948 | Heath | 273/127 B |
| 2,519,207 | A | * | 8/1950 | Wagner | 446/168 |
| 3,902,720 | A | * | 9/1975 | Collins | 473/83 |
| 3,989,252 | A | * | 11/1976 | Mattson | 273/120 R |
| 4,120,501 | A | * | 10/1978 | Atherton | 273/120 R |
| 4,909,517 | A | * | 3/1990 | Furlong | 273/352 |
| 5,344,143 | A | | 9/1994 | Yule | |
| 5,944,575 | A | | 8/1999 | Tolnay | |
| 6,536,763 | B1 | | 3/2003 | Braun | |

* cited by examiner

*Primary Examiner*—Raleigh W. Chiu

(57) ABSTRACT

A game includes a front plate that has first and second apertures formed therein. A ramp is partially seated within the first aperture and diverges outwardly therefrom. A semi-circular hollow tube has a bottom end connected to the first aperture and the ramp. Primary support brackets are coupled to a rear face of the front plate and are coextensively shaped. A linear plank has a proximal end connected to the tube, extends forwardly from the second aperture, is registered subjacent to the second aperture, and has an aperture formed at a distal end thereof. An auxiliary bracket is secured to the plank and the front plate. A ball is sized and shaped for traveling through the first and second apertures. The ball is positional along the tube and the plank for becoming lodged and anchored in the plank aperture when the user successfully discharges the ball upwardly through the tube.

18 Claims, 3 Drawing Sheets

TOY BOWLING GAME FOR PROVIDING PLAYER ENJOYMENT

CROSS REFERENCE TO RELATED APPLICATIONS

Not Applicable.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Technical Field

This invention relates to bowling games and, more particularly, to a miniature sized and portable toy bowling game for providing player enjoyment.

2. Prior Art

Various games and toys employing a ball and a track of some sort is known in the prior art. The general object of such games and toys is to roll the ball along a track or level plain of some type towards a desired location or position. Typically, the ball's initial position is higher than the final position thereof, thus potential energy is employed to displace the ball along the track. This means that the user/player has very limited involvement during game play, which in turn can result in the player quickly becoming bored with the toy.

Ball and track games are known where the ball's initial position is lower than the final position thereof. Thus some kinetic energy is required to displace the ball along the track. Unfortunately, such games are generally quite complicated, large and bulky in design, making them expensive and limiting their use to indoor applications only. The distance along which the must be traversed towards the goal in these games are fixed. Eventually, after continued play, the user determines the exact force with which the ball must be rolled to access the goal. Once the player reached this level the game no longer holds any challenge and they become bored therewith.

Accordingly, a need remains for a toy bowling game for providing player enjoyment in order to overcome the above-noted shortcomings. The present invention satisfies such a need by providing a bowling game that is convenient and easy to use, is affordable for all budgets, and provides entertainment for extended periods of time. Such a toy bowling game is simple in design, advantageously reducing the production and subsequent retail costs thereof. Both persons of beginner and advance levels are able to play the game simultaneously, thus the whole family can advantageously use in this toy at one time. This can foster and encourage much needed family interaction and growth. Furthermore, the toy bowling game can be played either indoors or outdoors, thus conveniently providing entertainment year round.

BRIEF SUMMARY OF THE INVENTION

In view of the foregoing background, it is therefore an object of the present invention to provide a toy bowling game for providing player enjoyment. These and other objects, features, and advantages of the invention are provided by a toy game for measuring a player's ability to exert a predetermined amount of controlled force.

The toy game includes a front plate that has first and second centrally oriented apertures formed therein. Such a first aperture may be registered below the second aperture wherein the first and second apertures are aligned with the bottom and top ends of the semi-circular tube respectively. The front plate preferably is vertically oriented and has an apex seated above the plank. Such a front plate may have a linear bottom edge and corrugated sides converging upwardly towards a center of the front plate such that the front plate effectively defines a shape of a mountain.

A ramp is partially seated within the first aperture and diverges outwardly therefrom. Such a ramp may have a sloped top surface rising from the ground surface and terminating at an elevated height intermediately of front and rear faces of the front plate.

A semi-circular hollow tube has a bottom end in fluid communication with the first aperture and the ramp respectively. Such a semi-circular tube may be statically and directly affixed to a rear face of the front plate. The semi-circular tube has a fixed and predetermined radius such that the semi-circular tube is conveniently hidden and not visible from a front side of the front plate.

A pair of primary support brackets are directly coupled to a rear face of the front plate in such a manner that the pair of primary support brackets rest on a ground surface during playing conditions. Such a pair of primary support brackets are coextensively shaped and equidistantly offset from the semi-circular tube.

A linear plank has a proximal end in fluid communication with the semi-circular tube. Such a plank extends distally and forwardly from the second aperture. The plank is registered subjacent to the second aperture. Such a plank further has an aperture formed at a distal end thereof.

An auxiliary bracket is directly secured to the plank and the front plate in such a manner that the plank effectively remains statically and horizontally conjoined to the front plate during playing conditions. Such an auxiliary bracket is connected directly to a bottom surface of the plank and the front face of the front plate respectively.

A spherical ball is suitably sized and shaped for effectively traveling through the first and second apertures. Such a ball is positional along the semi-circular tube and the plank so that the spherical ball becomes lodged and anchored in the aperture of the plank when the user successfully discharges the spherical ball upwardly through the semi-circular tube.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

It is noted the purpose of the foregoing abstract is to enable the U.S. Patent and Trademark Office and the public generally, especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

Figure 1:
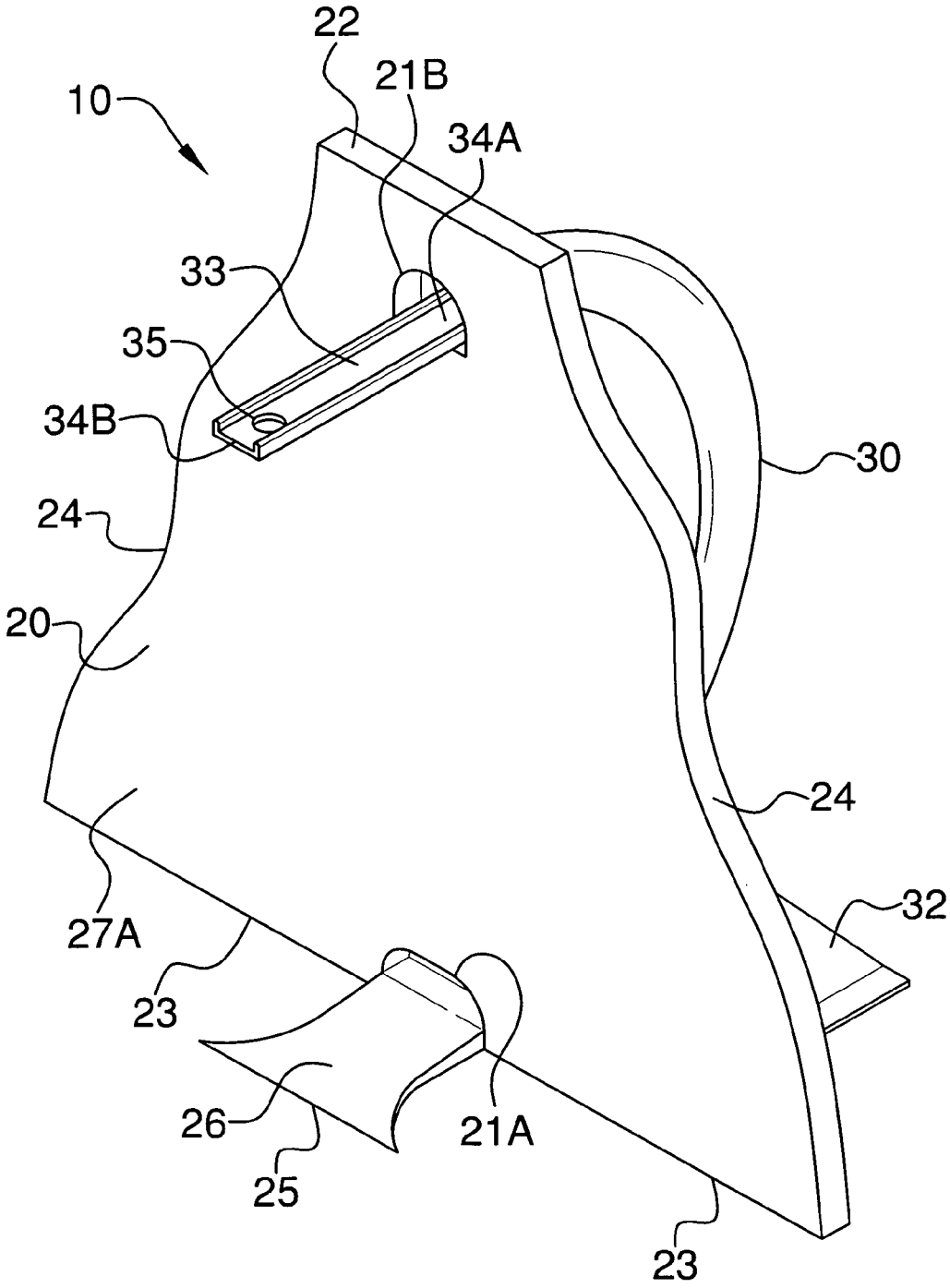
FIG. 1 is a perspective view showing a toy bowling game for providing player enjoyment, in accordance with the present invention.

The present invention will now be described more fully hereinafter with reference to the accompanying drawings, in which a preferred embodiment of the invention is shown. This invention may, however, be embodied in many different forms and should not be construed as limited to the embodiment set forth herein. Rather, this embodiment is provided so that this application will be thorough and complete, and will fully convey the true scope of the invention to those skilled in the art. Like numbers refer to like elements throughout the figures.

The assembly of this invention is referred to generally in FIGS. 1-4 by the reference numeral 10 and is intended to provide a toy bowling game for providing user entertainment. It should be understood that the assembly 10 may be used to provide user entertainment in many different types of settings and should not be limited to indoor use only.

Referring initially to FIGS. 1, 2, 3 and 4, the assembly 10 includes a front plate 20 that has first 21A and second 21B centrally oriented apertures 21 formed therein. Such a first aperture 21A is registered below the second aperture 21B wherein the first 21A and second 21B apertures are aligned with the bottom 31B and top 31A ends of the semi-circular tube 30 (described herein below) respectively. The front plate 20 is vertically oriented and has an apex 22 seated above the plank 33 (described herein below). Such a front plate 20 further has a linear bottom edge 23 and corrugated sides 24 converging upwardly towards the apex 22 of the front plate 20, which is essential such that the front plate 20 effectively defines a shape of a mountain. Of course, the front plate 20 may be alternately shaped for defining other structures, like a skyscraper, a tree or a windmill, to name a few, as is obvious to a person of ordinary skill in the art.

Figure 2:
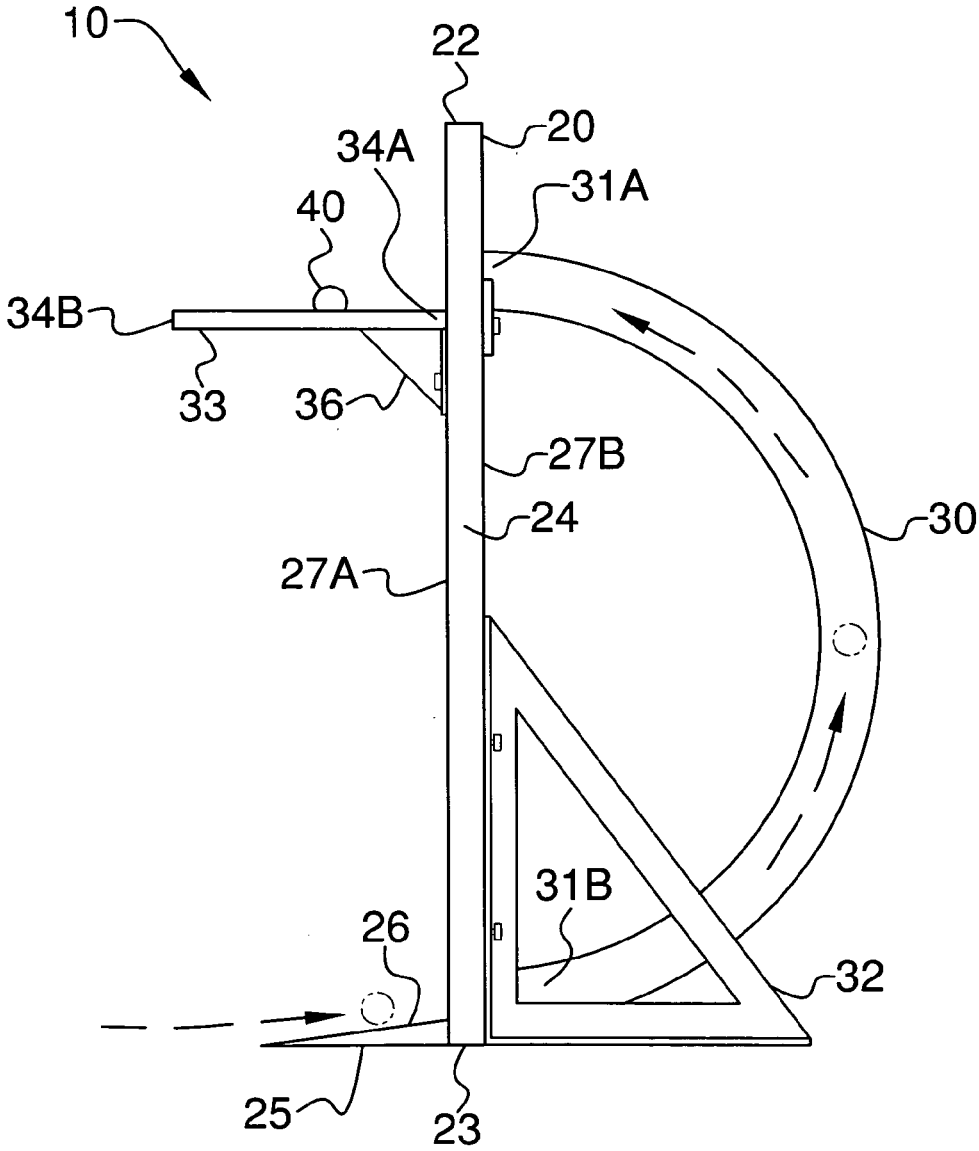
FIG. 2 is a side-elevational view of the assembly shown in FIG. 1.
Figure 3:
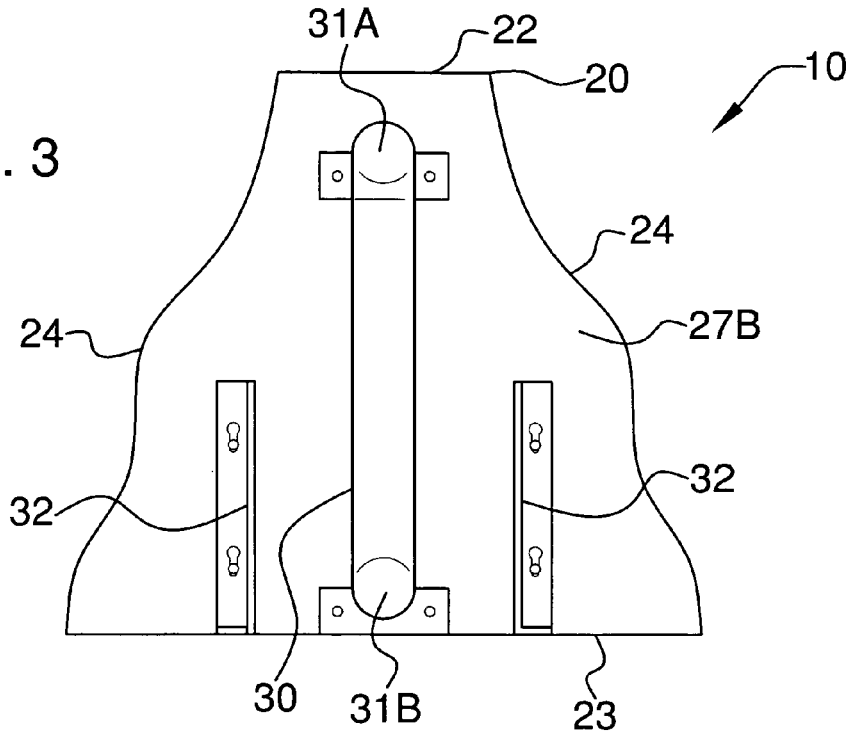
FIG. 3 is a rear-elevational view of the assembly shown in FIG. 1.
Figure 4:
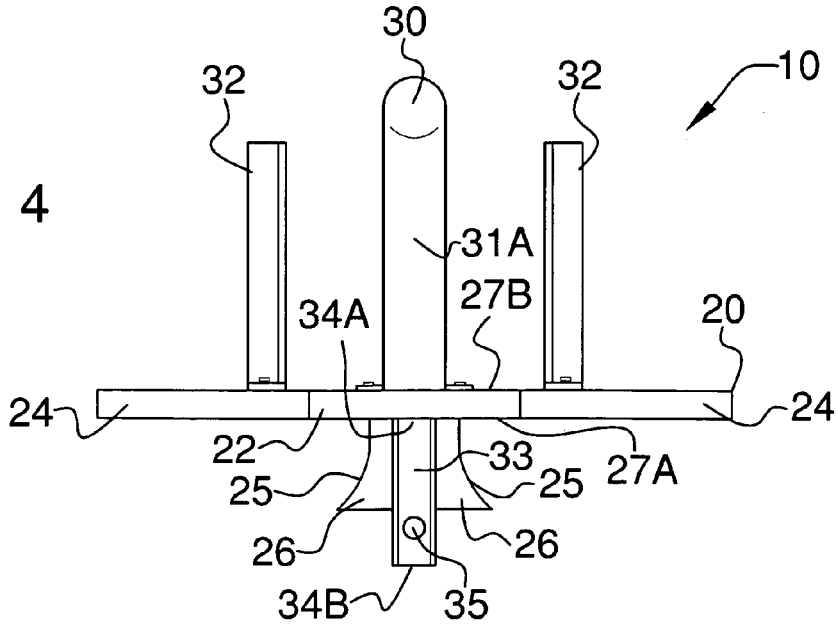
FIG. 4 is a top plan view of the assembly shown in FIG. 1.

Referring to FIGS. 1, 2 and 4, a ramp 25 is partially seated within the first aperture 21A and diverges outwardly therefrom. Such a ramp 25 has a sloped top surface 26 rising from the ground surface and terminating at an elevated height intermediately of front 27A and rear 27B faces of the front plate 20. Of course, the assembly 10 may be provided with a plurality of ramps 25 having alternate slopes for allowing a user to effectively adjust the difficulty of the games goal, as is obvious to a person of ordinary skill in the art.

Referring to FIGS. 1 through 4, a semi-circular hollow tube 30 has a bottom end 31B in fluid communication with the first aperture 21A and the ramp 25 respectively. Of course, the hollow tube 30 may be produced in shapes other than semi-circular shapes, as is obvious to a person of ordinary skill in the art. Such a semi-circular tube 30 is statically and directly affixed, without the use of intervening elements, to a rear face 27B of the front plate 20. The semi-circular tube 30 has a fixed and predetermined radius, which is important such that the semi-circular tube 30 is conveniently hidden and not visible from a front side of the front plate 20, thus effectively maintaining the mountain appearance of the front plate 20.

Again referring to FIGS. 1 through 4, a pair of primary support brackets 32 are directly coupled, without the use of intervening elements, to a rear face 27B of the front plate 20 in such a manner that the pair of primary support brackets 32 rest on a ground surface during playing conditions, which is crucial for effectively maintaining the front plate 20 at an upright position. Such a pair of primary support brackets 32 are coextensively shaped and equidistantly offset from the semi-circular tube 30.

Referring to FIGS. 1, 2 and 4, a linear plank 33 has a proximal end 34A in fluid communication with the semi-circular tube 30. Such a plank 33 extends distally and forwardly from the second aperture 21B. The plank 33 is registered subjacent to the second aperture 21B. Such a plank 33 further has an aperture 35 formed at a distal end 34B thereof. Of course, the plank 33 may be produced in alternate lengths and non-linear shapes for altering the game play difficulty of the assembly 10, as is obvious to a person of ordinary skill in the art.

Referring to FIG. 2, an auxiliary bracket 36 is directly secured, without the use of intervening elements, to the plank 33 and the front plate 20 in such a manner that the plank 33 effectively remains statically and horizontally conjoined to the front plate 20 during playing conditions. Such an auxiliary bracket 36 is connected directly, without the use of intervening elements, to a bottom surface 37 of the plank and the front face 27A of the front plate 20 respectively.

Again referring to FIG. 2, a spherical ball 40 is suitably sized and shaped for effectively traveling through the first 21A and second 21B apertures. Such a ball 40 is positional along the semi-circular tube 30 and the plank 33, which is crucial so that the spherical ball 40 becomes lodged and anchored in the aperture 35 of the plank 33 when the user successfully discharges the spherical ball 40 upwardly through the semi-circular tube 30. Of course, the assembly 10 may include a plurality of alternately colored spherical balls 40 for conveniently allowing multiple players to simultaneously partake in game play activities, as is obvious to a person of ordinary skill in the art.

In use, a player or players would first find a suitable in-door or out-doors location where the assembly 10 can be erected. If more than one person is partaking then they will agree on a specific location from which all players will roll their ball 40 towards the assembly 10. Of course, in the event that one or more players are significantly less skilled than the other players, their starting point may be more closely located to the assembly 10 than those of the more skilled players. This is a vital feature for allowing both skilled and non-skilled to simultaneously play with the same assembly 10. Each player then takes a turn to roll their ball 40 towards the assembly 10, wherein the goal is to roll the ball 40 onto the ramp 25, along the tube 30, out onto the plank 33, and finally coming to a rest in the aperture 35. Even if one player achieves this goal, the next player may attempt to displace the previous player's ball 40 from the aperture 35. After all players have had a chance to roll their ball 40 the winner is determined by the player whose ball is still lodged in the aperture 35.

While the invention has been described with respect to a certain specific embodiment, it will be appreciated that many modifications and changes may be made by those skilled in the art without departing from the spirit of the invention. It is intended, therefore, by the appended claims to cover all such modifications and changes as fall within the true spirit and scope of the invention.

In particular, with respect to the above description, it is to be realized that the optimum dimensional relationships for the parts of the present invention may include variations in size, materials, shape, form, function and manner of operation. The assembly and use of the present invention are deemed readily apparent and obvious to one skilled in the art.

What is claimed as new and what is desired to secure by Letters Patent of the United States is:

1. A toy game for measuring a player's ability to exert a predetermined amount of controlled force, said toy game comprising:

a front plate having first and second centrally oriented apertures formed therein;

a ramp partially seated within said first aperture and diverging outwardly therefrom;

a semi-circular hollow tube having a bottom end in fluid communication with said first aperture and said ramp respectively;

a pair of primary support brackets directly coupled to a rear face of said front plate in such a manner that said pair of primary support brackets rest on a ground surface during playing conditions;

a linear plank having a proximal end in fluid communication with said semi-circular tube, said plank extending distally and forwardly from said second aperture, said plank having an aperture formed at a distal end thereof;

an auxiliary bracket directly secured to said plank and said front plate in such a manner that said plank remains statically and horizontally conjoined to said front plate during playing conditions; and a spherical ball suitably sized and shaped for traveling through said first and second apertures, said ball being positional along said semi-circular tube and said plank such that said spherical ball becomes lodged and anchored in said aperture of said plank when the user exerts successfully discharges said spherical ball upwardly through said semi-circular tube.

2. The assembly of claim 1, wherein said front plate being vertically oriented and having an apex seated above said plank.

3. The assembly of claim 2, wherein said front plate having a linear bottom edge and corrugated sides converging upwardly towards a center of said front plate such that said front plate defines a shape of a mountain.

4. The assembly of claim 1, wherein said ramp having a sloped top surface rising from the ground surface and terminating at an elevated height intermediately of front and rear faces of said front plate.

5. The assembly of claim 1, wherein said semi-circular tube being statically and directly affixed to a rear face of said front plate, said semi-circular tube having a fixed and predetermined radius such that said semi-circular tube is hidden and not visible from a front side of said front plate.

6. The assembly of claim 1, wherein said first aperture being registered below said second aperture wherein said first and second apertures are aligned with said bottom and top ends of said semi-circular tube respectively.

7. A toy game for measuring a player's ability to exert a predetermined amount of controlled force, said toy game comprising:

a front plate having first and second centrally oriented apertures formed therein;

a ramp partially seated within said first aperture and diverging outwardly therefrom;

a semi-circular hollow tube having a bottom end in fluid communication with said first aperture and said ramp respectively;

a pair of primary support brackets directly coupled to a rear face of said front plate in such a manner that said pair of primary support brackets rest on a ground surface during playing conditions, said pair of primary brackets being coextensively shaped and equidistantly offset from said semi-circular tube;

a linear plank having a proximal end in fluid communication with said semi-circular tube, said plank extending distally and forwardly from said second aperture, wherein said plank is registered subjacent said second aperture, said plank having an aperture formed at a distal end thereof;

an auxiliary bracket directly secured to said plank and said front plate in such a manner that said plank remains statically and horizontally conjoined to said front plate during playing conditions; and a spherical ball suitably sized and shaped for traveling through said first and second apertures, said ball being positional along said semi-circular tube and said plank such that said spherical ball becomes lodged and anchored in said aperture of said plank when the user exerts successfully discharges said spherical ball upwardly through said semi-circular tube.

8. The assembly of claim 7, wherein said front plate being vertically oriented and having an apex seated above said plank.

9. The assembly of claim 8, wherein said front plate having a linear bottom edge and corrugated sides converging upwardly towards a center of said front plate such that said front plate defines a shape of a mountain.

10. The assembly of claim 7, wherein said ramp having a sloped top surface rising from the ground surface and terminating at an elevated height intermediately of front and rear faces of said front plate.

11. The assembly of claim 7, wherein said semi-circular tube being statically and directly affixed to a rear face of said front plate, said semi-circular tube having a fixed and predetermined radius such that said semi-circular tube is hidden and not visible from a front side of said front plate.

12. The assembly of claim 7, wherein said first aperture being registered below said second aperture wherein said first and second apertures are aligned with said bottom and top ends of said semi-circular tube respectively.

13. A toy game for measuring a player's ability to exert a predetermined amount of controlled force, said toy game comprising:

a front plate having first and second centrally oriented apertures formed therein;

a ramp partially seated within said first aperture and diverging outwardly therefrom;

a semi-circular hollow tube having a bottom end in fluid communication with said first aperture and said ramp respectively;

a pair of primary support brackets directly coupled to a rear face of said front plate in such a manner that said pair of primary support brackets rest on a ground surface during playing conditions, said pair of primary brackets being coextensively shaped and equidistantly offset from said semi-circular tube;

a linear plank having a proximal end in fluid communication with said semi-circular tube, said plank extending distally and forwardly from said second aperture, wherein said plank is registered subjacent said second aperture, said plank having an aperture formed at a distal end thereof;

an auxiliary bracket directly secured to said plank and said front plate in such a manner that said plank remains statically and horizontally conjoined to said front plate during playing conditions, wherein said auxiliary bracket is connected directly to a bottom surface of said plank and said front face of said front plate respectively; and a spherical ball suitably sized and shaped for traveling through said first and second apertures, said ball being positional along said semi-circular tube and said plank such that said spherical ball becomes lodged and anchored in said aperture of said plank when the user exerts successfully discharges said spherical ball upwardly through said semi-circular tube.

14. The assembly of claim 13, wherein said front plate being vertically oriented and having an apex seated above said plank.

15. The assembly of claim 14, wherein said front plate having a linear bottom edge and corrugated sides converging upwardly towards a center of said front plate such that said front plate defines a shape of a mountain.

16. The assembly of claim 13, wherein said ramp having a sloped top surface rising from the ground surface and terminating at an elevated height intermediately of front and rear faces of said front plate.

17. The assembly of claim 13, wherein said semi-circular tube being statically and directly affixed to a rear face of said front plate, said semi-circular tube having a fixed and predetermined radius such that said semi-circular tube is hidden and not visible from a front side of said front plate.

18. The assembly of claim 13, wherein said first aperture being registered below said second aperture wherein said first and second apertures are aligned with said bottom and top ends of said semi-circular tube respectively.

* * * * *